US006647899B1

(12) United States Patent
Lysien

(10) Patent No.: US 6,647,899 B1
(45) Date of Patent: Nov. 18, 2003

(54) SPLASH GUARD

(76) Inventor: Michael G. Lysien, 13365 Milnor Rd., Pickerington, OH (US) 43147

( * ) Notice: Subject to any disclaimer, the term of this patent is extended or adjusted under 35 U.S.C. 154(b) by 172 days.

(21) Appl. No.: 09/928,088

(22) Filed: Aug. 10, 2001

(51) Int. Cl.[7] ..... A47B 85/00
(52) U.S. Cl. ..... 108/24; 108/27; 312/140.4
(58) Field of Search ..... 108/24, 27, 50.18; 52/35, 287.1, 288.1, 800.1; 312/140.1, 140.2, 140.3, 140.4; 4/654, 656, 658, 692, 631

(56) References Cited

U.S. PATENT DOCUMENTS

| | | | | | |
|---|---|---|---|---|---|
| 2,785,937 | A | * | 3/1957 | Murray | 312/140.4 |
| 2,942,924 | A | * | 6/1960 | Stangert | 312/140.4 |
| 3,093,836 | A | * | 6/1963 | Christensen et al. | 108/24 |
| 4,073,240 | A | * | 2/1978 | Fly | 108/24 |
| D259,905 | S | | 7/1981 | Bell | |
| 4,423,568 | A | | 1/1984 | Gould | |
| 4,722,103 | A | * | 2/1988 | Kliebert | 4/658 |
| 4,765,001 | A | | 8/1988 | Smith | |
| 5,255,401 | A | * | 10/1993 | Sambrookes et al. | 4/605 |
| 5,357,639 | A | | 10/1994 | Zellner | |
| 5,365,619 | A | | 11/1994 | Solomon | |
| 5,377,359 | A | | 1/1995 | Jiang | |
| 5,625,910 | A | * | 5/1997 | Erickson et al. | 4/658 |
| 5,733,022 | A | * | 3/1998 | Whetstone | 312/140.4 |
| 5,771,504 | A | * | 6/1998 | Steiner | 4/610 |
| 6,253,395 | B1 | * | 7/2001 | Quam | 4/658 |
| 6,341,388 | B1 | * | 1/2002 | Roberts | 4/609 |

FOREIGN PATENT DOCUMENTS

| | | | |
|---|---|---|---|
| JP | 03221019 | * | 9/1991 |
| JP | 09229384 | * | 9/1997 |
| JP | 10127385 | * | 5/1998 |

* cited by examiner

*Primary Examiner*—Lanna Mai
*Assistant Examiner*—Hanh V. Tran

(57) ABSTRACT

A splash guard for use on an embalming table or the like. The splash guard includes a shield member having an upper portion for extending above the upper surface of the tabletop, a table rest for resting on the upper surface of the tabletop, and a mechanism for mounting the shield member to the table.

16 Claims, 2 Drawing Sheets

SPLASH GUARD

BACKGROUND OF THE INVENTION

1. Field of the Invention

The present invention relates to splash guards and more particularly pertains to a new splash guard for use on an embalming table or the like.

2. Description of the Prior Art

The use of splash guards is known in the prior art. More specifically, splash guards heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,377,359; 5,365,619; Des. 259,905; 4,765,001; 4,423,568; and 5,357,639.

While these devices fulfill their respective, particular objectives and requirements, the aforementioned patents do not disclose a new splash guard. The inventive device includes a shield member having an upper portion for extending above the upper surface of the tabletop, a table rest for resting on the upper surface of the tabletop, and a means for mounting the shield member to the table.

In these respects, the splash guard according to the present invention substantially departs from the conventional concepts and designs of the prior art, and in so doing provides an apparatus primarily developed for the purpose of use on an embalming table or the like.

SUMMARY OF THE INVENTION

In view of the foregoing disadvantages inherent in the known types of splash guards now present in the prior art, the present invention provides a new splash guard construction wherein the same can be utilized for use on an embalming table or the like.

The general purpose of the present invention, which will be described subsequently in greater detail, is to provide a new splash guard apparatus and method which has many of the advantages of the splash guards mentioned heretofore and many novel features that result in a new splash guard which is not anticipated, rendered obvious, suggested, or even implied by any of the prior art splash guards, either alone or in any combination thereof.

To attain this, the present invention generally comprises a shield member having an upper portion for extending above the upper surface of the tabletop, a table rest for resting on the upper surface of the tabletop, and a means for mounting the shield member to the table.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new splash guard apparatus and method which has many of the advantages of the splash guards mentioned heretofore and many novel features that result in a new splash guard which is not anticipated, rendered obvious, suggested, or even implied by any of the prior art splash guards, either alone or in any combination thereof.

It is another object of the present invention to provide a new splash guard which may be easily and efficiently manufactured and marketed.

It is a further object of the present invention to provide a new splash guard which is of a durable and reliable construction.

An even further object of the present invention is to provide a new splash guard which is susceptible of a low cost of manufacture with regard to both materials and labor, and which accordingly is then susceptible of low prices of sale to the consuming public, thereby making such splash guard economically available to the buying public.

Still yet another object of the present invention is to provide a new splash guard which provides in the apparatuses and methods of the prior art some of the advantages thereof, while simultaneously overcoming some of the disadvantages normally associated therewith.

Still another object of the present invention is to provide a new splash guard for use on an embalming table or the like.

Yet another object of the present invention is to provide a new splash guard which includes a shield member having an upper portion for extending above the upper surface of the tabletop, a table rest for resting on the upper surface of the tabletop, and a means for mounting the shield member to the table.

Still yet another object of the present invention is to provide a new splash guard that is especially designed for an embalming table.

Even still another object of the present invention is to provide a new splash guard that is easily attached to by means of either magnets, suction cups, or both.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
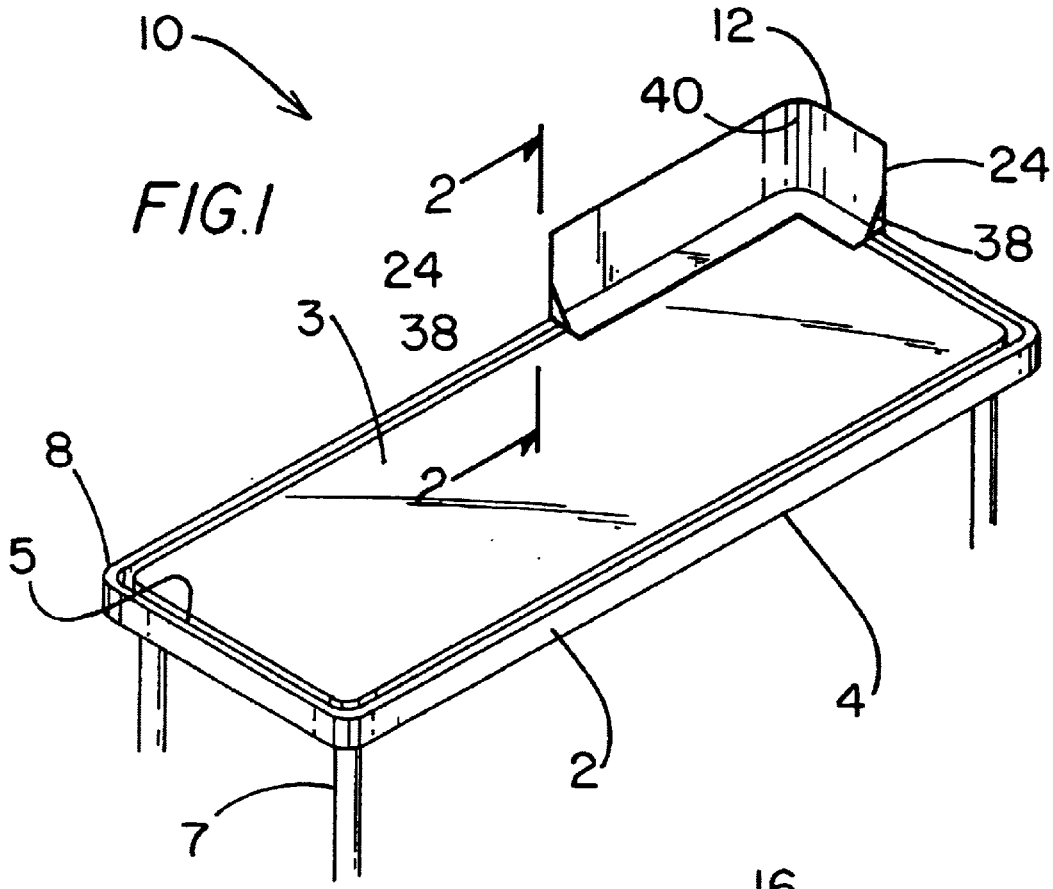
FIG. 1 is a perspective view of a new splash guard attached to a table according the present invention.
Figure 2:
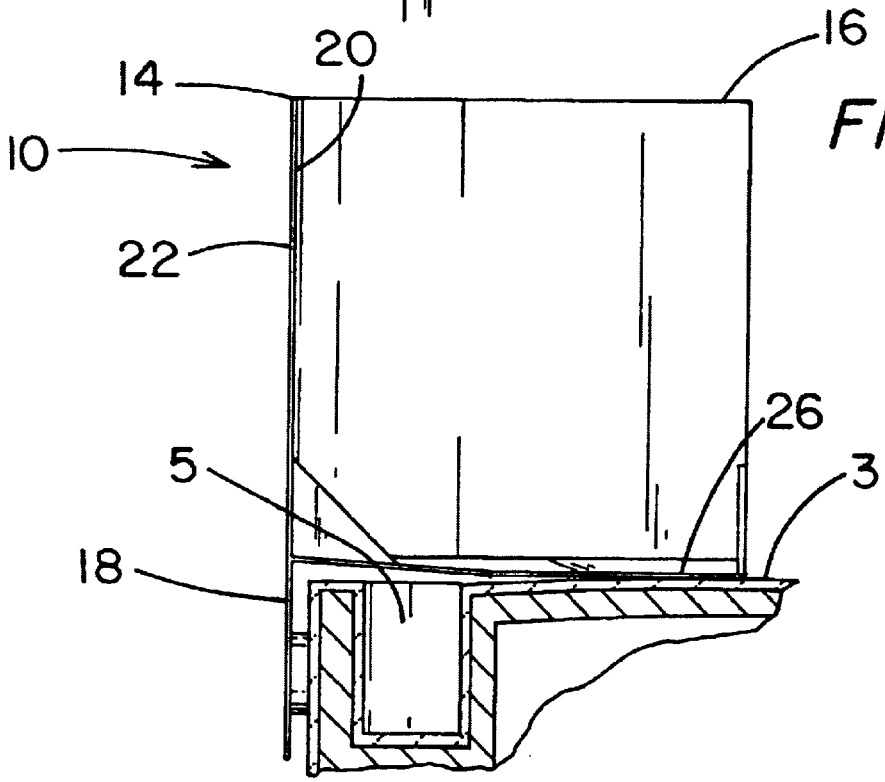
FIG. 2 is a end view of the present invention.
Figures 3, 4:
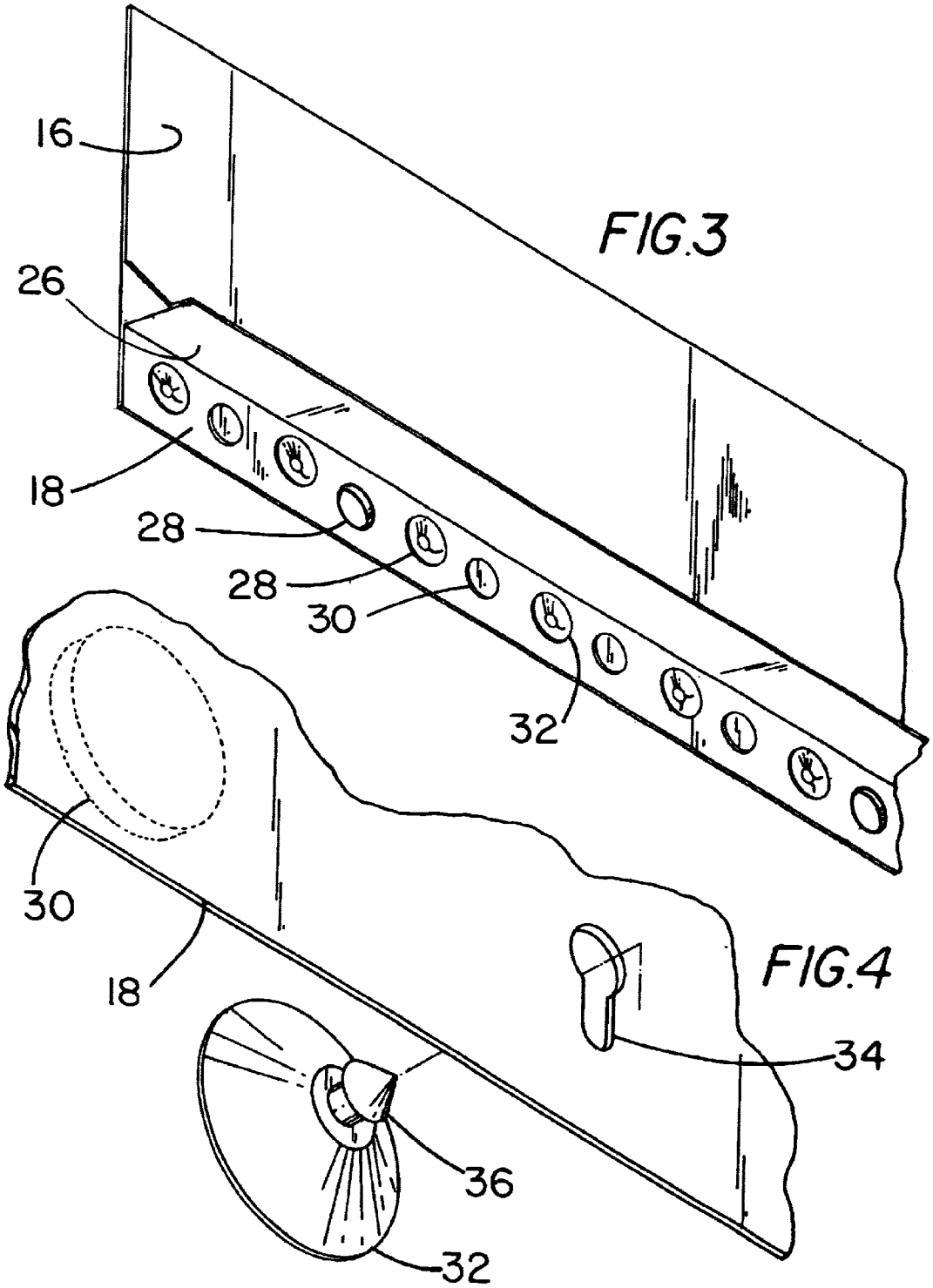
FIG. 3 is a perspective view depicting the mounting surface of the present invention.
FIG. 4 is a perspective view depicting the mounting means of the present invention.

With reference now to the drawings, and in particular to FIGS. 1 through 4 thereof, a new splash guard embodying the principles and concepts of the present invention and generally designated by the reference numeral 10 will be described.

As best illustrated in FIGS. 1 through 4, the splash guard 10 generally comprises a tabletop 2 with an upper surface 3 and a perimeter 4 thereabout. A perimeter draining channel 5 is formed in the upper surface 3 of the tabletop 2 and located adjacent to the perimeter 4 of the table. The tabletop 2 is substantially rectangular with a plurality of legs 7 for supporting the tabletop 2 above a floor surface.

A shield assembly 12 for removably mounting on the embalming table 6 comprises a shield member 14 with an upper portion 16 for extending above the upper surface 3 of the tabletop 2 and a lower portion 18 for positioning adjacent to the perimeter 4 of the tabletop 2.

The shield member 14 includes an inward surface 20 for orienting toward the tabletop 2 and an outward surface 22 for orienting away from the tabletop 2. The shield member 14 also includes opposite ends 24. The upper and lower portions 16, 18 may be substantially coplanar wherein the upper portion 16 and the lower portion 18 each have a width. The width of the upper portion 16 may be approximately 2 to 5 times the width of the lower portion 18.

A table rest 26 for resting on the upper surface 3 of the tabletop 2 extends from the shield member 14. The table rest 26 may be integrally mounted on the shield member 14 at a junction of the upper and lower portions 16, 18 of the shield member 14. The table rest 26 may extend generally perpendicular to the shield member 14. Preferably, the table rest 26 lies in a plane angled slightly away from the upper portion 16 and towards the lower portion 18.

A mounting means 28 may be provided for mounting the shield member 14 on the tabletop 2. The mounting means 28 is located on the lower portion 18 of the shielding member. The mounting means 28 may include a plurality of magnets 30 mounted on the lower portion 18 for mounting the shield member 14 to the perimeter 4 of tabletops 2 formed of a magnetically-active material. The plurality of magnets 30 may extend along a length of the lower portion 18 between the opposite ends 24 of the shield member 14.

The mounting means may include a plurality of suction cup members 32 mounted on the lower portion 18 for mounting the shield member 14 to the perimeter 4 of tabletops 2 that are formed of a non-magnetically-active material. The suction cup members 32 may extend along a length of the lower portion 18 between the opposite ends 24 of the shield member 14. Each of the suction cup members 32 is removably mounted on the lower portion 18. The lower portion 18 includes a plurality of apertures 34 therein. Each of the suction cup members 32 may include a knob portion 36 removably mounted in one of the apertures 34. Optionally, the magnets 30 and the suction cup members 32 may be positioned in an alternating array along the length of the lower portion 18 of the shield member 14.

A number of braces 38 may extend between the upper portion 16 of the shield member 14 and the table rest 26 and are located at each of opposite ends 24 of the table rest 26. The brace 38 may have a substantially triangular shape.

Optionally, a bend 40 may be formed in the shield assembly 12 so that the shield assembly 12 is designed to extend about a corner of the tabletop 8.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shield assembly for removably mounting on an embalming table, the shield assembly comprising:

a shield member having an upper portion for extending above the upper surface of the table top and a lower portion for positioning adjacent to the perimeter of the table top, the shield member having an inward surface for orienting toward the table top and an outward surface for orienting away from the table top, the shield member having opposite ends;

a table rest for resting on the upper surface of the table top, the table rest extending from the shield member, the table rest being integrally mounted on the shield member at a junction of the upper and lower portions of the shield member, the table rest extending outward from the inward surface of the shield member;

mounting means for mounting the shield member on the table top, the mounting means being located on the lower portion of the shield member; and wherein the mounting means includes a plurality of magnets mounted on the lower portion for mounting the shield member to the perimeter of table top formed of a magnetically-active material, the plurality of magnets extending along a length of the lower portion between the opposite ends of the shield member.

2. The shield assembly of claim 1 wherein the mounting means includes a plurality of suction cup members mounted on the lower portion for mounting the shield member to the perimeter of table top that are formed of a non-magnetically-active material, the suction cup members extending along a length of the lower portion between the opposite ends of the shield member.

3. The shield assembly of claim 2 wherein each of the suction cup members are removably mounted on the lower portion, the lower portion having a plurality of apertures therein, each of the suction cup members having a knob portion removably mounted in one of the apertures.

4. The shield assembly of claim 2 wherein the magnets and the suction cup members are positioned in an alternating array along the length of the lower portion of the shield member.

5. The shield assembly of claim 1 additionally comprising a brace extending between the upper portion of the shield member and the table rest at each of opposite ends of the table rest.

6. The shield assembly of claim 1 wherein a bend is formed in the shield assembly so that the shield assembly is adapted to extend about a corner of the table top.

7. The shield assembly of claim 1 wherein the upper and lower portions of the shield member are substantially coplanar.

8. The shield assembly of claim 1 wherein the upper portion and the lower portion each have a width, and wherein the width of the upper portion is approximately 2 to 5 times the width of the lower portion.

9. The shield assembly of claim 1 wherein the table rest is oriented generally perpendicular to the shield member.

10. The shield assembly of claim 1 wherein the table rest lies in a plane angled slightly away from the upper portion and towards the lower portion.

11. A fluid shield system comprising:

an embalming table including a table top with an upper surface and a perimeter thereabout;

a shield assembly for removably mounted on the embalming table, the shield assembly comprising:

a shield member having an upper portion for extending above the upper surface of the table top and a lower portion for positioning adjacent to the perimeter of the table top, the shield member having an inward surface for orienting toward the table top and an outward surface for orienting away from the table top, the shield member having opposite ends;

mounting means for mounting the shield member on the table top, the mounting means being located on the lower portion of the shield member; and wherein the mounting means includes a plurality of magnets mounted on the lower portion for mounting the shield member to the perimeter of table top formed of a magnetically-active material, the plurality of magnets extending along a length of the lower portion between the opposite ends of the shield member.

12. The system of claim 11 wherein the shield assembly additionally comprises a table rest for resting on the upper surface of the table top, the table rest extending from the shield member, the table rest being integrally mounted on the shield member at a junction of the upper and lower portions of the shield member, the table rest extending outward from the inward surface of the shield member.

13. The system of claim 12 wherein the table top includes a perimeter draining channel is formed in the upper surface thereof, perimeter draining channel being located adjacent to the perimeter of the table, and wherein the table rest lies above the perimeter draining channel when the shield assembly in mounted on the table top.

14. The system of claim 11, wherein the mounting means includes a plurality of suction cup members mounted on the lower portion for mounting the shield member to the perimeter of table top that are formed of a non-magnetically-active material, the suction cup members extending along a length of the lower portion between the opposite ends of the shield member.

15. The system of claim 14 wherein the magnets and the suction cup members are positioned in an alternating array along the length of the lower portion of the shield member.

16. A fluid shield system comprising:

an embalming table comprising:

a table top with an upper surface and a perimeter thereabout;

wherein a perimeter draining channel is formed in the upper surface of the table top and located adjacent to the perimeter of the table, the table top being substantially rectangular; and a plurality of legs for supporting the table top above a floor surface;

a shield assembly for removably mounting on the embalming table, the shield assembly comprising:

a shield member having an upper portion for extending above the upper surface of the table top and a lower portion for positioning adjacent to the perimeter of the table top, the shield member having an inward surface for orienting toward the table top and an outward surface for orienting away from the table top, the shield member having opposite ends, the upper and lower portions being substantially coplanar, wherein the upper portion and the lower portion each have a width, and wherein the width of the upper portion is approximately 2 to 5 times the width of the lower portion;

a table rest for resting on the upper surface of the table top, the table rest extending from the shield member, the table rest being integrally mounted on the shield member at a junction of the upper and lower portions of the shield member, the table rest extending generally perpendicular to the shield member, the table rest lying in a plane angled slightly away from the upper portion and towards the lower portion, mounting means for mounting the shield member on the table top, the mounting means being located on the lower portion of the shielding member, the mounting means including:

a plurality of magnets mounted on the lower portion for mounting the shield member to the perimeter of table top formed of a magnetically-active material, the plurality of magnets extending along a length of the lower portion between the opposite ends of the shield member; and a plurality of suction cup members mounted on the lower portion for mounting the shield member to the perimeter of table top that are formed of a non-magnetically-active material, the suction cup members extending along a length of the lower portion between the opposite ends of the shield member, each of the suction cup members being removably mounted on the lower portion, the lower portion having a plurality of apertures therein, each of the suction cup members having a knob portion removably mounted in one of the apertures;

wherein the magnets and the suction cup members are positioned in an alternating array along the length of the lower portion of the shield member;

a brace extending between the upper portion of the shield member and the table rest at each of opposite ends of the table rest, the brace having a substantially triangular shape;

wherein a bend is formed in the shield assembly so that the shield assembly is adapted to extend about a corner of the table top.

* * * * *